US005272509A

United States Patent [19]

Pitts et al.

[11] Patent Number: 5,272,509

[45] Date of Patent: Dec. 21, 1993

[54] LIQUID DISPENSING APPARATUS

[75] Inventors: Ian Pitts, Bassingbourn; James E. Knight, Watton at Stone; Duncan I. Stevenson, Welwyn Garden City; Andrew E. Taylor; John W. D. Cooper, both of Hitchin, all of England

[73] Assignee: Xerox Corporation, Stamford, Conn.

[21] Appl. No.: 943,253

[22] Filed: Sep. 10, 1992

[30] Foreign Application Priority Data

Sep. 11, 1991 [GB] United Kingdom ..... 9119480

[51] Int. Cl.[5] ..... G03G 15/20

[52] U.S. Cl. ..... 355/284; 118/264

[58] Field of Search ..... 355/284; 118/260, 261, 118/264, 268, 270

[56] References Cited

U.S. PATENT DOCUMENTS 4,231,653 11/1990 Nagahara et al. .

4,905,049 2/1990 Bickerstaff et al. ..... 355/284

FOREIGN PATENT DOCUMENTS 55-124171 9/1980 Japan ..... 355/284

*Primary Examiner*—Jan H. Pendegrass

[57] ABSTRACT

The invention relates to a liquid dispensing apparatus suitable for use in the fuser of an electrostatographic recording machine such as, for example, a xerographic copier or a printer. The apparatus includes a trough (41), a wick (100) extending along its length and a roller (47) in contact with the wick (100). A metering blade (49) is located adjacent the roller (47) in such a manner as to scrape off excess liquid from the surface of the roller (47), the metering blade (49) being disposed relative to the wick (100) such that the excess liquid falls on the wick (100) thereby ensuring saturation of the wick (100). Return paths for the excess liquid are provided between the wick (100) and the wall of the trough (41) so as to prevent build up of the excess liquid above the wick (100).

13 Claims, 5 Drawing Sheets

LIQUID DISPENSING APPARATUS

Figure 1:
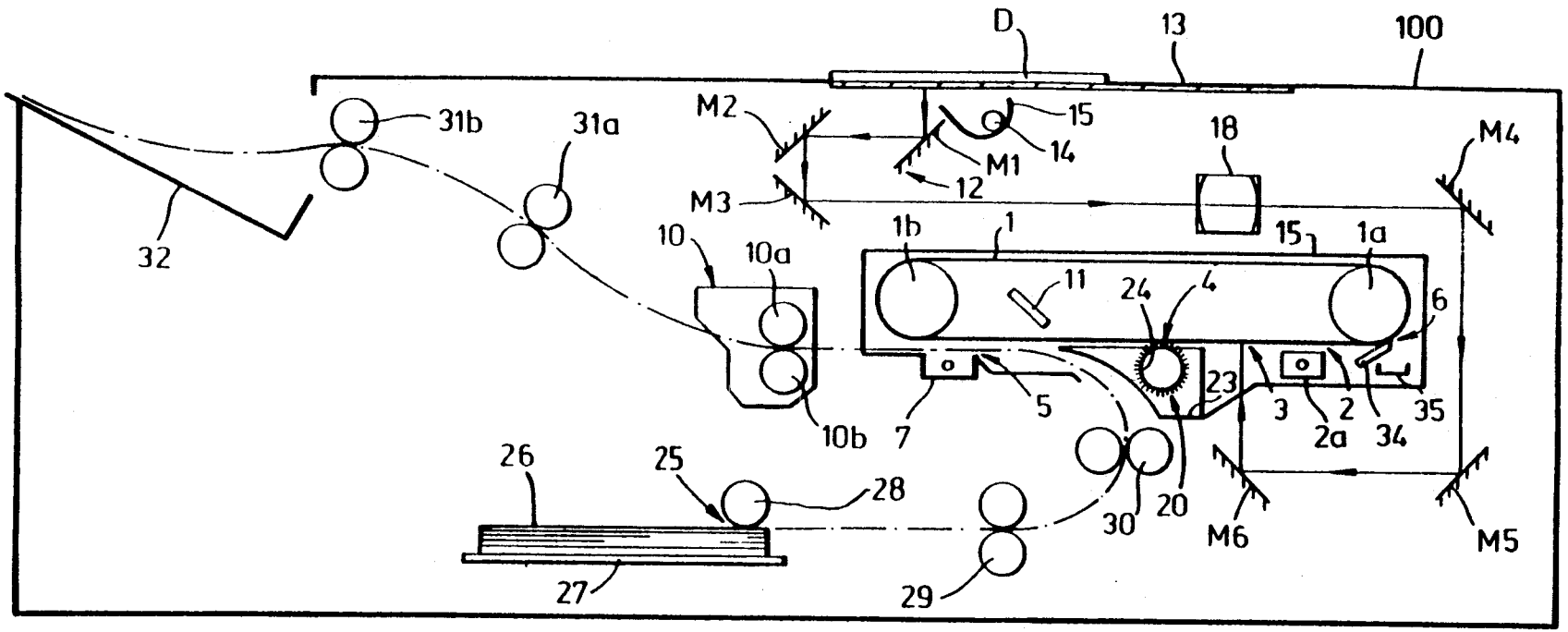

This invention relates generally to a liquid dispensing apparatus which is particularly, although not exclusively, suitable for use in the fuser of an electrostatographic recording machine such as, for example, a xerographic copier or a printer.

In a xerographic copier or printer a light image of an original document to be reproduced is recorded in the form of a latent electrostatic image on a photosensitive member. The latent image is rendered visible by the application of a resin-based powder known as toner. The visual toner image is transferred electrostatically from the photosensitive member on the sheets of paper or other substrates. The toner image is then fixed or "fused", for example by applying heat and pressure, which causes the toner material to become soft and tacky whereby it is able to flow into the fibres or pores of the substrate or otherwise upon the surface thereof. Thereafter, as the toner material cools, it solidifies and is bonded firmly to the substrate. In the electrostatographic art generally the use of thermal energy and pressure for fixing toner images on to a substrate is well known.

It has long been recognised that one of the fastest and most positive methods of applying both heat and pressure for fusing the toner image to the substrate is by direct contact of the resin-based toner image with a hot surface such as a heat roller which also applies pressure to the substrate. One approach is to pass the substrate with the toner image thereon between a pair of opposed rollers forming a nip, at least one of the rollers being internally heated. The actual temperature and pressure ranges will of course vary depending upon the softening range of the particular resin used in the toner. Typically, however, it will be necessary to heat the toner powder above 180° C. Temperatures of 198° C. or even higher are not uncommon in commercial fusers. Corresponding nip pressures are in the range of 690 to $1380kNm^2$.

A problem with this kind of fuser is that, as the toner becomes tacky, it can stick to the surface of the fuser roller which is undesirable because some of the toner on the fuser roller can then be transferred to subsequent substrates being fused and, moreover, those subsequent substrates will in their turn give rise to even more toner sticking to the fuser roller. This effect, known as "offset", clearly impairs copy quality. Furthermore, if the rollers are rotated when there is no substrate present in the nip therebetween, toner may also be transferred from the fuser roller to the backup roller so that when a substrate subsequently passes through the nip some of the toner may be transferred to the reverse side thereof.

An arrangement for minimising the problem of offset has been to provide a fuser roller with an outer surface or covering of, for example, polytetrafloroethene known by the trade name Teflon, to which a liquid release agent such as silicone oil is applied. The thickness of the Teflon is typically of the order of tens of microns and the thickness of the oil is less than 1 micron. Silicone based oils, for example polydimethylsiloxane, which possess a relatively low surface energy, have been found to be suitable for use in the heated fuser roller environment where Teflon constitutes the outer surface of the fuser roller. In practice, a thin layer of silicone oil is applied to the surface of the heated roller to form an interface between the roller surface and the toner images carried on the substrate. Thus, a low surface energy layer is presented to the toner as it passes through the fuser nip thereby preventing toner from offsetting to the fuser roller surface.

In attempts to improve the quality of the image fused by a heat roller fuser, such rollers have been provided with conformable surfaces comprising silicone rubber or Viton (Trademark of E I Du Pont for a series of fluoroelastomers based on the copolymer of vinyladinefluoride and hexafluoropropylene). As in the case of the Teflon coated fuser roller, release fluids such as silicone based oils are applied to the surface of the silicone rubber or Viton to both minimise offsetting and to facilitate stripping. When the fuser system is one which provides for applying silicone oil to silicone rubber or Viton, a low viscosity silicone oil (i.e. in the order of 100 to 1000 centistokes) has most commonly been employed, although liquids of relatively high viscosity, for example 12,000 to 60,000 centistokes and higher, have also been used.

Various forms of applicator have been employed to supply the liquid release agent to the surface of the fuser roller. Thus, for example, U.S. Pat. No. 4,231,653 discloses an applicator comprising an elongate trough for containing a supply of release oil. A wick which is partially immersed in the release oil supply draws the oil up from the trough for application to the fuser via a pair of cooperating rollers in pressure contact, namely a driven oil application roller and a freely rotatable oil supply roller. The wick is in engagement with the oil supply roller and thus applies the release oil directly to the surface thereof. The oil supply roller slips on the application roller and is not rotated when there is some oil present between the two rollers, but as the oil runs out the oil supply roller is driven by the oil application roller since the coefficient of friction therebetween is increased. In other words, the oil supply roller is rotated only when there is little or no oil on the surface of the oil application roller due to the application of oil to the fuser and thus the cooperating roller pair acts as a metering device for checking the amount of release oil conveyed to the fuser.

Generally in prior art applicators the release oil is introduced into the supply trough at a single inlet usually at one end of the trough and distribution of the oil along the full length of the trough relies (a) on the oil reaching a level in the trough and (b) on the capillary capability of the wick. These processes tend to be relatively slow especially in view of the viscosity of the release oil and consequently points along the trough remote from the inlet may receive insufficient oil for stripping or may even suffer complete oil starvation particularly if the machine-and hence the trough-is tilted. The provision of additional oil inlets along the length of the trough would also aid distribution but this would increase cost and may not be possible if stringent space constraints have to be observed.

One method of alleviating the difficulties encountered with prior art applicators is to ensure that the trough is kept full with an adequate level of oil. This may be accomplished by overfilling the system, and by providing a weir over which excess oil flows into a spillover chamber. A pump is provided to feed the oil from the spillover chamber back into the trough. To ensure that excess oil on the surface of the oil supply roller, often referred to as the metering roller, is returned to the trough a metering blade made of a suitable material, e.g. a fluorosilicate elastomer, checks the thickness of the oil coating on the surface of the metering roller.

Despite these measures we have found that to meet increased demands for copiers and printers difficulties are still encountered in ensuring adequate saturation of the wick. In high volume uses, there may not be enough time for the wick to deliver any oil and oil starvation results. Furthermore, in attempting to overcome these difficulties further difficulties are then encountered in ensuring that there is no build up of excess oil on the wick such that flooding occurs from the applicator.

It is an object of the present invention to provide a liquid dispensing apparatus for alleviating the problem of oil starvation to the wick and to prevent excess oil building up on the wick whereby flooding of the excess oil is prevented.

Accordingly, the present invention provides a liquid dispensing apparatus including an elongate dispensing container for containing a supply of liquid, a wick extending in the container along at least a portion of the length thereof, and a roller disposed adjacent the wick with its axis substantially parallel to the longitudinal axis of the container in such manner that a layer of liquid is applied to the surface of the roller by the wick and a metering device adjacent said roller in such a manner as to scrape off liquid in excess of a predetermined layer thickness on the surface of the roller, characterised in that the metering device is disposed relative to the wick such that the excess liquid falls onto the wick thereby ensuring saturation of the wick, and further characterised by at least one liquid return path defined between the wick and the container whereby the excess liquid is returned to lower parts of the container preventing a build up of the excess liquid above the wick.

In a preferred embodiment the wick is supported on the surface of the container by a plurality of ribs, the spaces defined between each pair of adjacent ribs and the wick defining respective return channels for the liquid, the ribs being angled, for example at typical 45° to the longitudinal axis of the container, thereby enabling the liquid to be redistributed along the length of the trough for re-application to the roller.

The angled ribs can promote rapid and effective delivery of excess oil from above the wick along the full length of the trough, and have the advantage of being a simple configuration which does not require any significant extra-space compared with prior art applicators. The ribs may be provided in a side wall of the trough and, as the trough is generally moulded from plastics material, the ribs can be readily incorporated without increased cost. Alternatively, however, the ribs may be provided on a separate insert located in the trough.

In one application the liquid dispensing apparatus is used as a release oil applicator in a toner fusing apparatus of a xerographic copier or a printer.

Accordingly, the present invention also provides an apparatus for fusing toner images on copy substrates including a heat and pressure fuser and a release oil applicator therefor, the release oil applicator including an elongate trough for containing a supply of release oil, a wick extending in the trough along at least a portion of the length thereof, and a roller disposed adjacent the wick with its axis substantially parallel to the longitudinal axis of the trough in such a manner that a layer of release oil is applied to the surface of the roller by the wick and a metering device adjacent said roller in such a manner as to scrape off release oil in excess of a predetermined layer thickness on the surface of the roller, characterised in that the metering device is disposed relative to the wick such that excess oil falls onto the wick thereby ensuring saturation thereof, and further characterised by at least one oil return path defined between the wick and the trough whereby the excess oil is returned to lower parts of the trough preventing a build up of excess oil above the wick.

Figure 2:
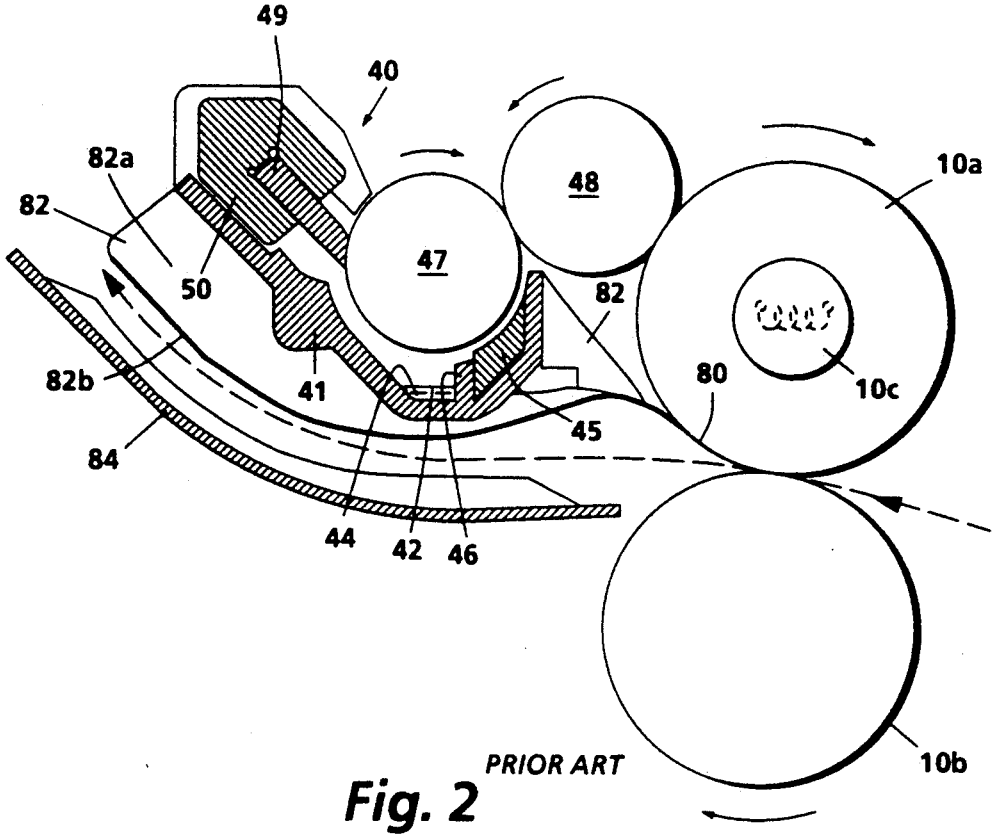
PRIOR ART Fig. 2
Figure 3:
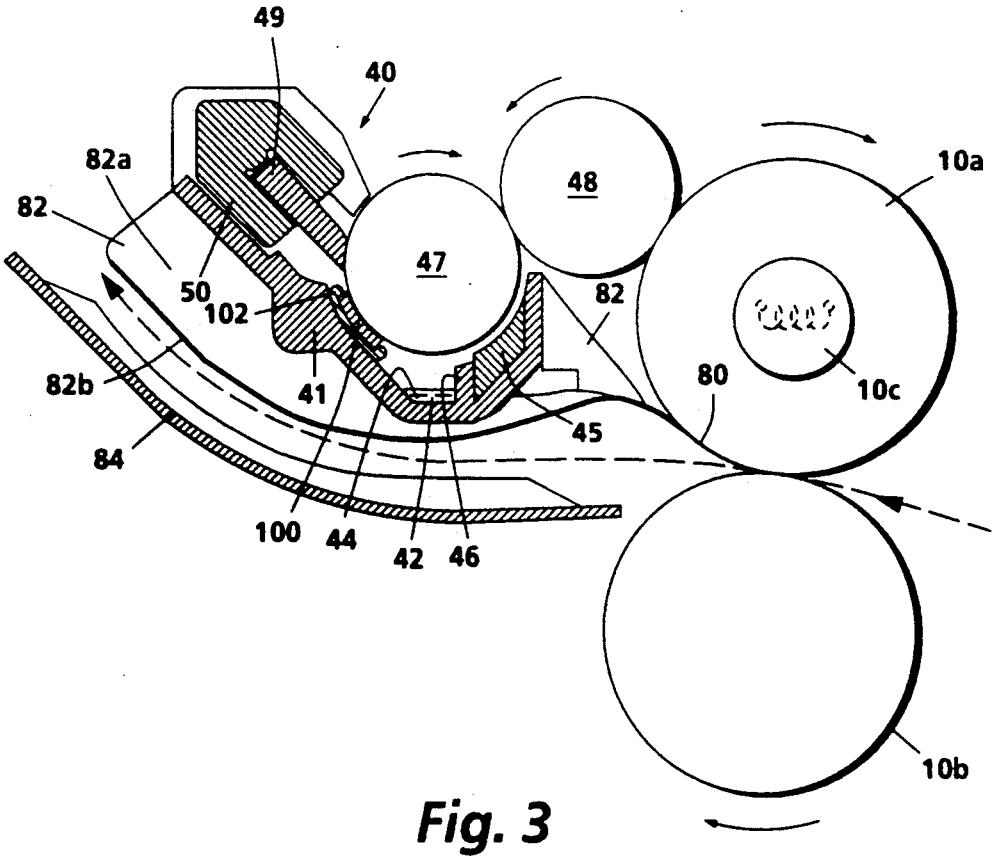
Figures 4, 5:
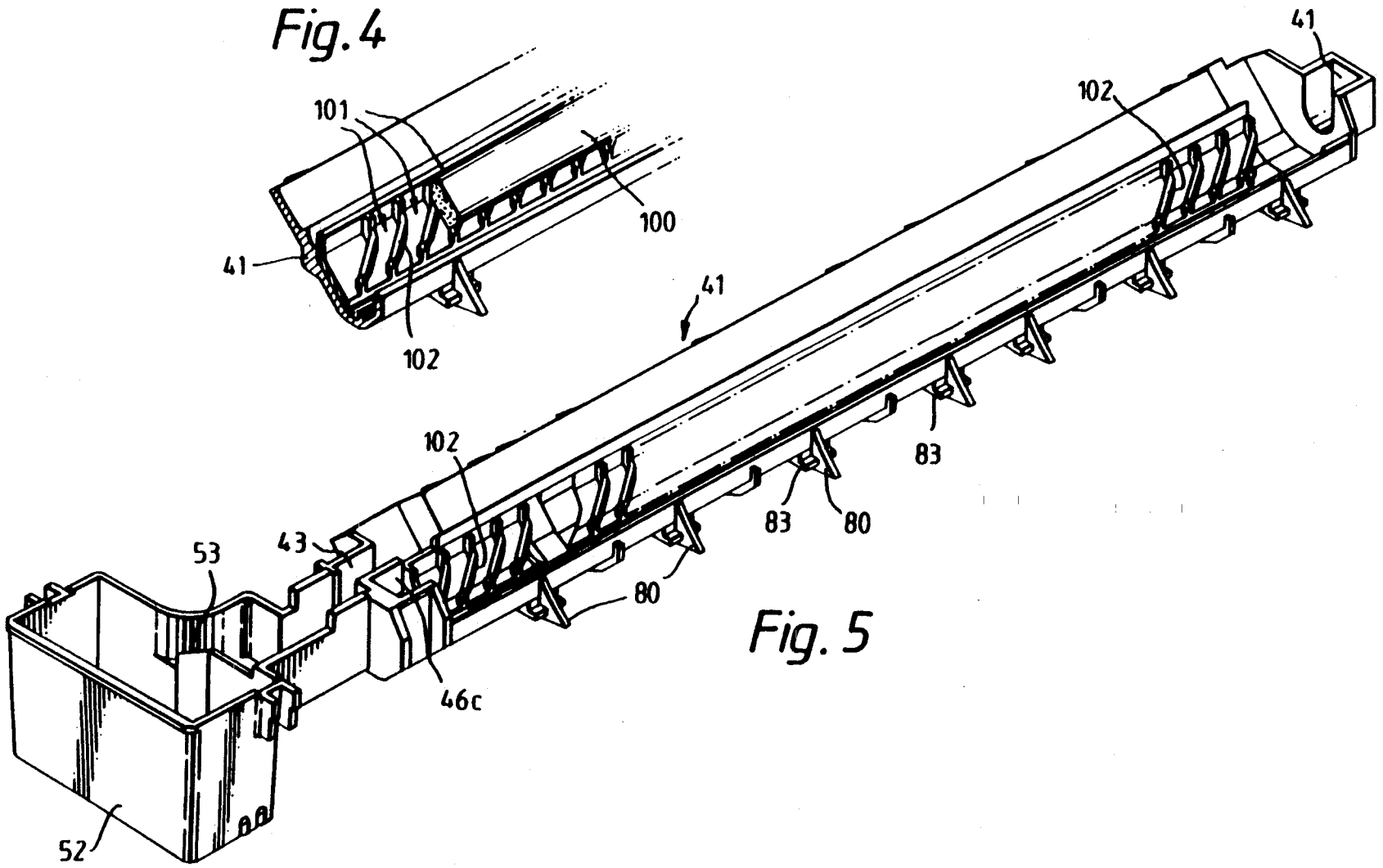
Figure 6:
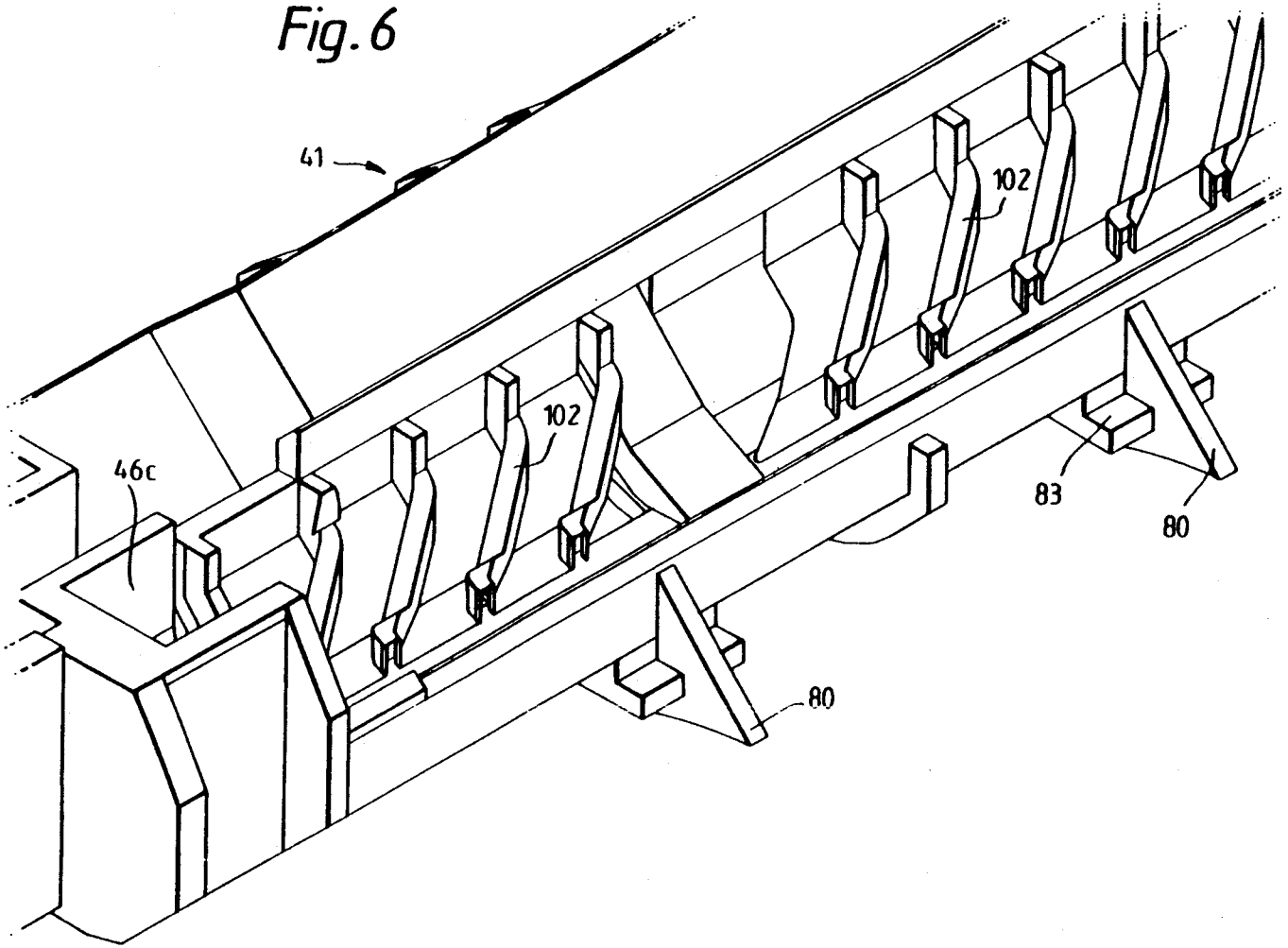
Figure 7:
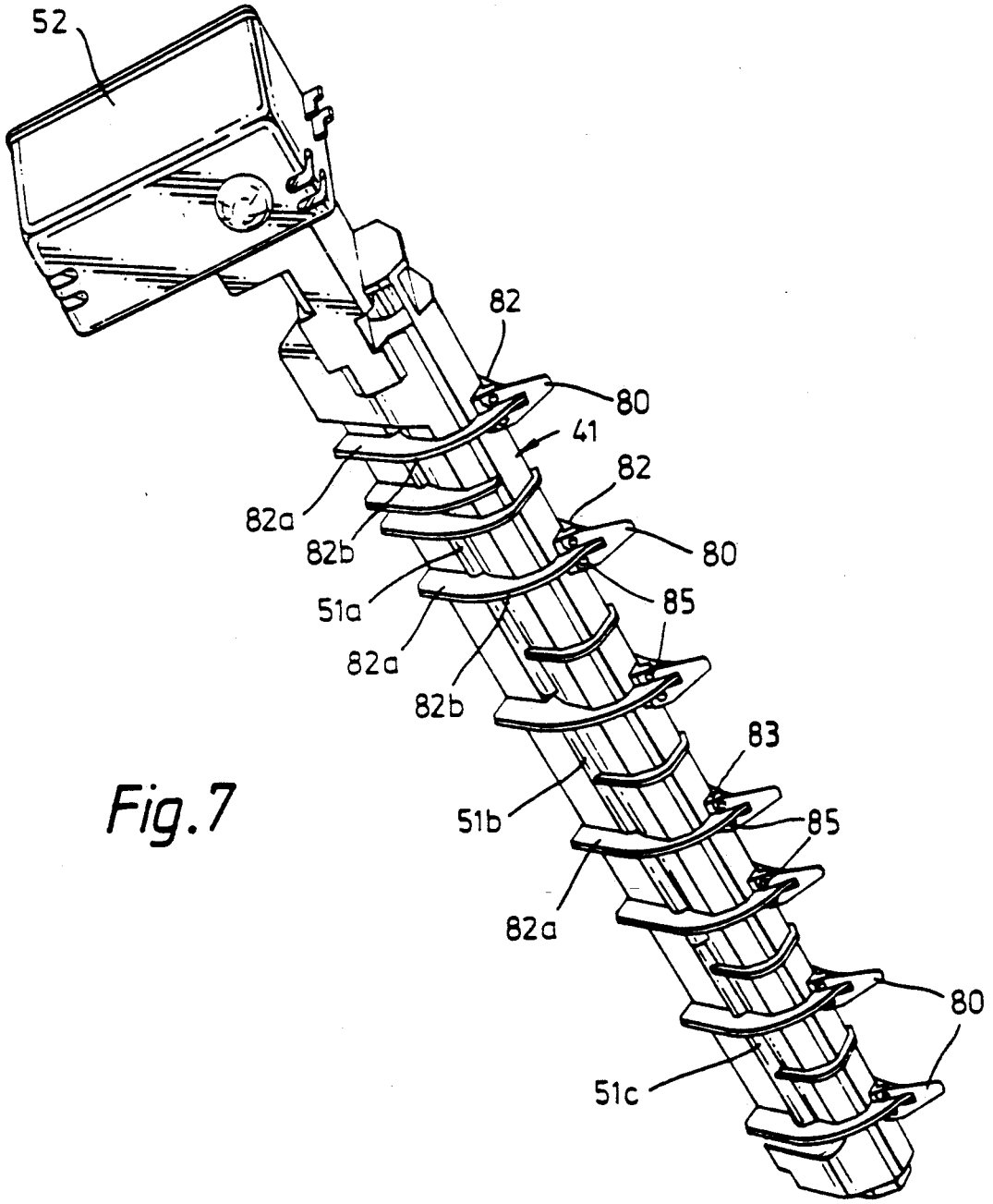

The invention will be described further, by way of examples, with reference to the accompanying drawings, in which:

FIG. 1 is a schematic cross section of a xerographic copier incorporating a fuser apparatus employing a release oil applicator, FIG. 2 is an enlarged cross section of the fuser apparatus in FIG. 1 showing a cross section through a prior art release oil applicator, FIG. 3 is an enlarged cross section of the fuser apparatus in FIG. 1 showing a cross section through a release oil applicator according to one embodiment of the present invention and FIG. 4 is a schematic part cross section perspective view from above showing the inside of the applicator trough with a portion of the wick in position according to one embodiment of the invention, FIG. 5 is a perspective view from above showing the inside of the applicator trough, FIG. 6 is an enlarged detail of the trough of FIG. 5 and FIG. 7 is a perspective view showing the underside of the trough of FIG. 5.

It is noted that in FIGS. 1 to 7 the same reference signs are used to indicate the same features.

The invention will be described hereinafter in relation to its use as a release oil applicator in a toner fusing apparatus of a xerographic copier. It will be understood that this is by way of example only as the release oil applicator can likewise be used in a toner fusing apparatus of a printer or as a liquid dispensing apparatus in applications outside the xerographic field.

Referring firstly to FIG. 1, there is shown schematically a xerographic copy machine incorporating an embodiment of the present invention. The machine includes an endless flexible photoreceptor belt 1 mounted for rotation (in the clockwise direction as shown in FIG. 1) about support rollers 1*a* and 1*b* to carry the photosensitive imaging surface of the belt 1 sequentially through a series of xerographic processing stations, namely a charging station 2, an imaging station 3, a development station 4, a transfer station 5, and a cleaning station 6.

The charging station 2 comprises a corotron 2*a* which deposits a uniform electrostatic charge on the photoreceptor belt 1.

An original document D to be reproduced is positioned on a platen 13 and is illuminated in known manner a narrow strip at a time by a light source comprising a tungsten halogen lamp 14. Light from the lamp is concentrated by an elliptical reflector 15 to cast a narrow strip of light on to the side of the original document D facing the platen 13. Document D thus exposed is imaged on to the photoreceptor 1 via a system of mirrors M1 to M6 and a focussing lens 18. The optical image selectively discharges the photoreceptor in image configuration, whereby an electrostatic latent image of the original document is laid down on the belt surface at imaging station 3. In order to copy the whole original document the lamp 14, the reflector 15, and mirror M1 are mounted on a full rate carriage (not shown) which travels laterally at a given speed directly below the platen and thereby scans the whole document. Because of the folded optical path the mirrors M2 and M3 are mounted on another carriage (not shown) which travels laterally at half the speed of the full rate carriage in order to maintain the optical path constant. The photoreceptor 1 is also in motion whereby the image is laid down strip by strip to reproduce the whole of the original document as an image on the photoreceptor.

By varying the speed of the scan carriages relative to the photoreceptor belt 1 it is possible to alter the size of the image along the length of the belt, i.e. in the scanning direction. In full size copying, that is to say with unity magnification, the speed of the full rate carriage and the speed of the photoreceptor belt are equal. Increasing the speed of the scan carriage makes the image shorter, i.e. reduction, and decreasing the speed of the scan carriage makes the image longer, i.e. magnification.

The image size can also be varied in the direction orthogonal to the scan direction by moving the lens 18 along its optical axis closer to the original document i.e. closer to mirrors M2 and M3, for magnification greater than unity, and away from the mirrors M2 and M3 for reduction, i.e. magnification less than unity. When the lens 18 is moved, the length of the optical path between the lens and the photoreceptor, i.e. the image distance, is also varied by moving mirrors M4 and M5 in unison to ensure that the image is properly focused on the photoreceptor 1. For this purpose mirrors M4 and M5 are suitably mounted on a further carriage (not shown).

At the development station 4, a magnetic brush developer system 20 develops the electrostatic latent image into visible form. Here, toner is dispensed from a hopper (not shown) into developer housing 23 which contains a two-component developer mixture comprising a magnetically attractable carrier and the toner, which is deposited on the changed area of belt 1 by a developer roller 24.

The developed image is transferred at transfer station 5 from the belt to a sheet of copy paper which is delivered into contact with the belt in synchronous relation to the image from a paper supply system 25 in which a stack of paper copy sheets 26 is stored on a tray 27. The top sheet of the stack in the tray is brought, as required, into feeding engagement with a top sheet separator/-feeder 28. Sheet feeder 28 feeds the top copy sheet of the stack towards the photoreceptor around a 180° path via two sets of nip roller pairs 29 and 30. The path followed by the copy sheets is denoted by a broken line in FIG. 1. At the transfer station 5 a transfer corotron 7 provides an electric field to assist in the transfer of the toner particles thereto.

The copy sheet bearing the developed image is then stripped from the belt 1 and subsequently conveyed to a fusing station 10 which comprises a heated roller fuser to which release oil is applied as described in more detail below. The image is fixed to the copy sheet by the heat and pressure in the nip between the two rollers **10*a* and 10*b* of the fuser. The final copy is fed by the fuser rollers into catch tray 32 via two further nip roller pairs 31*a* and 31*b***.

After transfer of the developed image from the belt some toner particles usually remain on the surface of the belt, and these are removed at the cleaning station 6 by a doctor blade 34 which scrapes residual toner from the belt. The toner particles thus removed fall into a receptacle 35 below. Also, any electrostatic charges remaining on the belt are discharged by exposure to an erase lamp 11 which provides an even distribution of light across the photoreceptor surface. The photoreceptor is then ready to be charged again by the charging corotron **2*a*** as the first step in the next copy cycle.

The photoreceptor belt 1, the charge corotron **2*a*, the developer system 20, the transfer corotron 7, the cleaning station 6, and the erase lamp 11 may all be incorporated in a process unit 15 adapted to be removably mounted in the main assembly 100** of the xerographic copier.

As shown in more detail in FIG. 2, the fuser 10 according to an arrangement in the prior art comprises a driven heat roller **10*a* made for example of a steel cylinder coated in Viton (Trademark) and having a 1 KW tungsten filament lamp 10*c* disposed along its axis. A driven pressure roller 10*b* which may also comprise a steel cylinder with a Viton coating is urged against the heat roller 10*a*, for example by springs (not shown) suitably applying a force of approximately 68 kg, thereby forming a nip between the two rollers 10*a* and 10*b*** where fusing takes place.

The path of a copy sheet through the fuser is represented by a broken-line arrow in FIG. 2. In order to prevent toner offset and to aid stripping the copy sheet from the heat roller **10*a*, a silicone lubricating oil is applied to the surface roller 10*a* by an applicator 40**.

The oil applicator 40 comprises an elongate trough 41 (FIGS. 2 to 7). The release oil 42 is introduced into the trough 41 from a supply source (not shown) at an inlet 43 at one end and flows along a channel 44 at the base of the trough towards the opposite end thereof. A wick 45 is retained internally adjacent the side of the trough by a castellated wall 46 extending upwardly from the base of the trough. Release oil is able to flow through the gaps in the wall 46 to reach the wick 45 which draws the oil up and applies it to the surface of a metering roller 47 against which the wick 45 engages. The metering roller 47, in the form of a tube made for example of stainless steel is journaled in bearings (**46*b*, 46*c*) at the extremities of the trough 41. The manner in which the metering arrangement operates is described in detail below. The metering roller applies the release oil to a donor roller 48 with which it is in contact and the donor roller 48 transfers a controlled amount of oil to the surface of the heat roller 10*a*. The donor roller 48 may be in the form of a tube made of for example aluminum coated with silicone rubber. The direction of rotation of all the rollers is shown by short solid-line arrows in FIG. 3, but it is noted that only the heat roller 10*a* is directly driven. The pressure roller 10*b*, the donor roller 48 and metering roller 47 are both driven by the heat roller 10*a***.

A metering blade 49 which may be made for example of an elastomer such as Viton (trade mark) is fixed in a holder 50 with the holder end of the blade set at a predetermined distance from the surface of the metering roller 47 thus controlling the loading of the blade on the roller 47. In this manner the blade removes surplus oil from the roller 47 in a cutting tool fashion to leave thereon a coating of a predetermined thickness.

The metering blade 49 is arranged such that the surplus oil removed from the roller 47 will find its way under gravity back to channel 44 in the base of trough 41.

In order to set up a complete continuous circulation system the channel 44 at the base of the trough 41 may slope gently downwards towards the end of the trough adjacent the input. Any excess oil may then be collected in a reservoir adjacent the input and the level of supply oil in the trough may be set at a desired limit by providing a dam 53 at the entrance to the reservoir at a predetermined height so that only when the oil level exceeds the desired level will it spill over the dam into the reservoir.

An embodiment of the fuser in accordance with the invention is illustrated in FIGS. 3 and 4 the same reference signs indicating the same features as those illustrated in FIG. 2. One of the main differences is the provision of a shim backed wick 100 touching the metering roller 47 at a point just below the metering blade 49. Excess oil dropping off the blade 49 will fall onto the wick 100 ensuring saturation of the wick 100 and wetting of the metering roll surface at all times. As the oil supply into the applicator is greater than its need there is usually an excess of oil being returned from the blade 49 onto the wick 100. This excess oil can build up above the wick 100 to the point where it floods out from the fuser subsystem into the machine. To prevent this build up of oil an oil return is provided behind the wick 100. This return is provided by a plurality of ribs 102 supporting the shim backed wick 100, the spaces defined between each pair of adjacent ribs 102 and the wick 100 defining respective return channels 101 for the oil. The ribs 102 are angled, forming a series of enclosed sections, enabling oil to be transported to the front or rear of the applicator trough 41 as required by the design. The ribs 102 are provided as an integral part of the trough 41, which is conveniently moulded from plastics material, thereby enabling the ribs 102 to be incorporated without increased cost. Alternatively the ribs 102 may be provided on a separate insert located in the trough 41.

In addition to the release oil, mechanical aids in the form of resilient blade-like stripper fingers 80 are provided at intervals along the length of the fuser system to strip the copy sheet paper from the fuser. To this end the remote end of the fingers 80 bears against the heat roller surface on the exit side of the fuser as shown in FIG. 2. As can be seen most clearly in FIGS. 3 to 6, the stripper fingers 80 which may for example be made of steel shim, are tapered and present a truncated V-shape with the tips of the fingers having a convex curvature. The stripper fingers 80 are fixed directly, to mounting platforms 83 by means of projections integral with the external wall of the trough 41, which are heat stake to form a rivet head 85. Each finger 80 has a centrally located slot 81 enabling the finger 80 to be fitted on to an external rib 82 formed integrally on the external wall of the trough. During stripping the fingers 80 tend to be deflected upwards in such manner as to increase their curvature adjacent the fuser roller 10*a*. On the upper side of the fingers 80 the ribs 82 protrude further than the slots 81 so that if the fingers are subjected to a particularly strong stripping—and hence bending—force, they abut the ribs 82 with thus provide strengthening support preventing them from flipping over in the direction of rotation of the fuser roller 10*a* while at the same time reducing the effective unsupported length so that the fingers tend to curve away from the heat roller 10*a* preventing gouging.

On the underside of the fingers 80 the ribs 82 extend around substantially the whole perimeter of the external wall surface of the trough and flare into wider portions 82*a* away from the stripper fingers 80. The ribs 82*a* have a convex outer edge 82*b*. Each rib 82 is integral with the trough so that the whole item may be moulded as a unit for example from plastics material. The ribs 82 form a two-fold function, firstly they act as strengthening members for the trough, and secondly they act as an upper guide device for a copy sheet exiting the fuser rollers. The copy sheet exiting the fuser is also guided on its lower side by a guide member 84 complementary to the curved edge 82*b* of ribs 82. The guide member 84 is suitably made of sheet metal and is mounted on the fuser assembly 10. The guide ribs 82 are provided at intervals along the length of the trough, and are positioned so that one is located near the edge of all common paper sizes to inhibit jams due to edges snagging or curling. The depth of the ribs 82 is sufficient to safeguard against copy sheets contacting the underside of the trough which would generate undesirable drag forces which is beneficial because at this stage the copy sheets are hot and damp and as such their normal dry paper strength is diminished. Moreover, it will be noted that with this arrangement the stripper fingers 80 are in line with the ribs 82 so that they too function in the same beneficial manner in relation to various paper sizes and form a continuous smooth path in combination with the ribs.

In view of the foregoing description it will be evident to a person skilled in the art that various modifications of the embodiments described may be made within the scope of the present invention. For example, whereas the description above relates to the use of a liquid dispensing apparatus in a fuser apparatus of a xerographic copier it will be appreciated that it can also be utilized in a fuser apparatus of a printer. The liquid dispensing apparatus can also find applications outside the xerographic fields for use in equipment, where there is a need to maintain a liquid supply to a metering roller by means of a wick.

We claim:

1. A liquid dispensing apparatus including an elongate dispensing container for containing a supply of liquid, a wick extending along at least a portion of the length thereof, and a roller disposed adjacent the wick with its axis substantially parallel to the longitudinal axis of the container in such manner that a layer of liquid is applied to the surface of the roller by the wick and a metering device adjacent said roller in such a manner as to scrape off liquid in excess of a predetermined layer thickness on the surface of the roller, characterised in that the metering device is disposed relative to the wick such that the excess liquid falls onto the wick thereby ensuring saturation of the wick, and further characterised by at lease one liquid return path defined between the wick and the container whereby the excess liquid is returned to lower parts of the container preventing a build up of the excess liquid above the wick and further characterized in that the wick is supported on the surface of the container by a plurality of ribs, the spaces defined between each pair of adjacent ribs and the wick defining respective return channels for the liquid.

2. A liquid dispensing apparatus as claimed in claim 1, characterised in that the ribs are angled to the longitudinal axis of the container thereby enabling the liquid to be redistributed along the length of the container.

3. A liquid dispensing apparatus as claimed in claim 2, characterised in that respective sets of ribs are each arranged at a different angle to the longitudinal axis of the container.

4. A liquid dispensing apparatus as claimed in claim 3, characterised in that all of the ribs are arranged at the same angle to the longitudinal axis of the container.

5. A liquid dispensing apparatus as claimed in any one of claims 1 and 3 to 5, characterised in that the ribs form an integral part of the container.

6. A liquid dispensing apparatus as claimed in any one of claims 1 and 2 to 5, characterised in that the ribs are provided on a separate insert located in the container.

7. A release oil applicator for use in a toner fusing apparatus of a xerographic copier or a printer, characterised in that the release oil applicator includes a liquid dispensing apparatus as claimed in any one of claims 1 and 2 to 4.

8. An apparatus for fusing toner images on copy substrates including a heat and pressure fuser and a release oil applicator therefor, the release oil applicator including an elongate trough for containing a supply of release oil, a wick extending in the trough along at least a portion of the length thereof, and a roller disposed adjacent the wick with its axis substantially parallel to the longitudinal axis of the trough in such a manner that a layer of release oil is applied to the surface of the roller by the wick and a metering device adjacent said roller in such a manner as to scrape off release oil in excess of a predetermined layer thickness on the surface of the roller, characterised in that the metering device is disposed relative to the wick such that excess oil falls onto the wick, thereby ensuring saturation thereof, and further characterised by at least one oil return path defined between the wick and the trough whereby the excess oil is returned to lower parts of the trough preventing a build up of excess oil above the wick and still further characterized in that the wick is supported on the surface of the container by a plurality of ribs, the spaces defined between each pair of adjacent ribs and the wick defining respective return channels for the liquid.

9. An apparatus as claimed in claim 8, characterized in that the ribs are angled to the longitudinal axis of the container thereby enabling the liquid to be redistributed along the length of the container.

10. An apparatus as claimed in claim 8, characterized in that respective sets of ribs are each arranged at a different angle to the longitudinal axis of the container.

11. An apparatus as claimed in claim 8, characterized in that all of the ribs are arranged at the same angle to the longitudinal axis of the contained.

12. A printer incorporating an apparatus as claimed in claim 8.

13. A xerographic copier incorporating an apparatus as claimed in claim 8.

* * * * *